US010167802B2

(12) United States Patent
Baier et al.

(10) Patent No.: US 10,167,802 B2
(45) Date of Patent: Jan. 1, 2019

(54) METHOD FOR INJECTION VALVES

(71) Applicant: Continental Automotive GmbH, Hannover (DE)

(72) Inventors: Andreas Baier, Regensburg (DE); Tany Gargiso, Donaustauf (DE); Walter Schrod, Regensburg (DE); Hans-Joerg Wiehoff, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 119 days.

(21) Appl. No.: 15/322,161

(22) PCT Filed: Jun. 17, 2015

(86) PCT No.: PCT/EP2015/063543
§ 371 (c)(1),
(2) Date: Dec. 26, 2016

(87) PCT Pub. No.: WO2015/197439
PCT Pub. Date: Dec. 30, 2015

(65) Prior Publication Data

US 2017/0152804 A1 Jun. 1, 2017

(30) Foreign Application Priority Data

Jun. 27, 2014 (DE) ..... 10 2014 212 377

(51) Int. Cl.
*F02D 41/20* (2006.01)

(52) U.S. Cl.
CPC .. *F02D 41/2096* (2013.01); *F02D 2041/2027* (2013.01); *F02D 2041/2055* (2013.01); *F02D 2041/2058* (2013.01)

(58) Field of Classification Search
CPC ..... F02D 41/2096; F02D 41/2055; F02D 41/2058; F02D 41/2027
(Continued)

(56) References Cited

U.S. PATENT DOCUMENTS 4,452,210 A * 6/1984 Sasayama ..... F02D 41/20 123/490
6,147,433 A * 11/2000 Reineke ..... F02D 41/2096 310/316.03
(Continued)

FOREIGN PATENT DOCUMENTS

DE 10256456 A1 7/2004 ..... F02D 41/20
DE 102006059070 A1 6/2008 ..... F02D 41/20
(Continued)

OTHER PUBLICATIONS

German Office Action, Application No. 102014212377.1, 5 pages, dated Mar. 3, 2015.
(Continued)

*Primary Examiner* — Hieu T Vo
*Assistant Examiner* — Arnold Castro
(74) *Attorney, Agent, or Firm* — Slayden Grubert Beard PLLC

(57) ABSTRACT

The present disclosure relates to internal combustion engines. The teachings thereof may be embodied in methods for determining a state of an injection valve of an internal combustion engine. Some methods may include actuating the piezo actuator in a pulse-width-modulated manner; recording the T on and/or T off switching times of the pulse-width-modulated piezo output stage of the piezo actuator; and evaluating the recorded switching times to derive the state of the injection valve.

8 Claims, 2 Drawing Sheets

(58) Field of Classification Search
USPC ..... 310/316.03
See application file for complete search history.

(56) References Cited

U.S. PATENT DOCUMENTS

| | | | | |
|---|---|---|---|---|
| 6,236,190 | B1 * | 5/2001 | Hoffmann | F02D 41/2096 310/317 |
| 6,253,736 | B1 * | 7/2001 | Crofts | F02M 47/027 123/467 |
| 7,525,783 | B2 | 4/2009 | Chemisky et al. | 361/139 |
| 2001/0035697 | A1 * | 11/2001 | Rueger | F02D 41/2096 310/316.03 |
| 2002/0008440 | A1 * | 1/2002 | Hedenetz | F02D 41/2096 310/316.03 |
| 2002/0117939 | A1 * | 8/2002 | Kawamoto | F02D 41/2096 310/316.03 |
| 2003/0205949 | A1 * | 11/2003 | Rueger | F02D 41/2096 310/316.03 |
| 2005/0072854 | A1 * | 4/2005 | Baranowski | F02D 41/2096 239/5 |
| 2006/0082252 | A1 * | 4/2006 | Allmendinger | F02D 41/2096 310/316.03 |
| 2006/0255302 | A1 * | 11/2006 | Aspelmayr | F02D 41/20 251/129.06 |
| 2007/0018534 | A1 | 1/2007 | Sciortino et al. | 310/316.01 |
| 2010/0059021 | A1 | 3/2010 | Rau et al. | 123/478 |
| 2014/0034747 | A1 | 2/2014 | Wiehoff et al. | 239/5 |

FOREIGN PATENT DOCUMENTS

| | | | | |
|---|---|---|---|---|
| DE | 102011007393 | B3 | 9/2012 | F02D 41/00 |
| EP | 1689004 | A1 | 8/2006 | H01L 41/04 |
| EP | 1746318 | B1 | 11/2007 | F16K 31/00 |
| GB | 2476105 | A | 6/2011 | F02D 41/20 |
| WO | 2003/081007 | A1 | 10/2003 | F02D 41/20 |
| WO | 2015/197439 | A1 | 12/2015 | F02D 41/20 |

OTHER PUBLICATIONS

International Search Report and Written Opinion, Application No. PCT/EP2015/063543, 21 pages, dated Sep. 25, 2015.

* cited by examiner

METHOD FOR INJECTION VALVES

CROSS-REFERENCE TO RELATED APPLICATIONS

This application is a U.S. National Stage Application of International Application No. PCT/EP2015/063543 filed Jun. 17, 2015, which designates the United States of America, and claims priority to DE Application No. 10 2014 212 377.1 filed Jun. 27, 2014, the contents of which are hereby incorporated by reference in their entirety.

TECHNICAL FIELD

The present disclosure relates to internal combustion engines. The teachings thereof may be embodied in methods for determining a state of an injection valve of an internal combustion engine.

BACKGROUND

For internal combustion engines with injection valves, accuracy and robustness of the injection quantity should be very high under all operating conditions and over the entire service life of the relevant vehicle. To determine an injection valve state, the voltage or charge or current may indicate significant features (e.g., by means of local determination of extreme values). However, in the typical evaluation methods, a large number of influencing factors have to be taken into account, so the methods are very complex since all the relevant interference variables have to be filtered out. Contemporary concepts use feedback signals (e.g., voltage or charge) from a piezo actuator in the injector to identify individual static points of the nozzle needle position during the actual injection process (relying on the piezo-electric effect). However, this information is subject to large interference variable influences because the piezo injector is in use at the same time as both actuator and sensor.

SUMMARY

The teachings of the present disclosure enable methods which provide simple identification of injection valve states in a way which may reduce sensitivity to interference variables. Some methods may be used to determine a state of an injection valve of an internal combustion engine in which the nozzle needle of the valve is activated by means of a piezo actuator which is actuated in the pulse-width-modulated manner. In some embodiments, the T on and/or T off switching times of the pulse-width-modulated piezo output stage of the piezo actuator are evaluated and the state of the injection valve is derived from the result which is obtained.

In some embodiments, the pulse-width modification is carried out by evaluating comparator thresholds.

In some embodiments, the shifting of the voltage difference $U_{DCDC}-U_P$ (terminal voltage minus piezo voltage), brought about by a non-uniform change in the piezo voltage, is detected and evaluated as a change in the switching time behavior.

In some embodiments, the prespecified value and/or the real voltage at the injector are mapped by measuring the ON times (T on).

In some embodiments, the ON (T on) time and OFF (T off) time are measured.

In some embodiments, the ON (T on) time and OFF (T off) time are measured in the actuation path.

In some embodiments, the times are measured upstream of the gate driver and/or directly at the gate of the power MOS.

In some embodiments, the mean value of the actuation pulse is measured.

BRIEF DESCRIPTION OF THE DRAWINGS

The following description uses an exemplary embodiment in conjunction with the drawings, in which.

DETAILED DESCRIPTION

Figure 1:
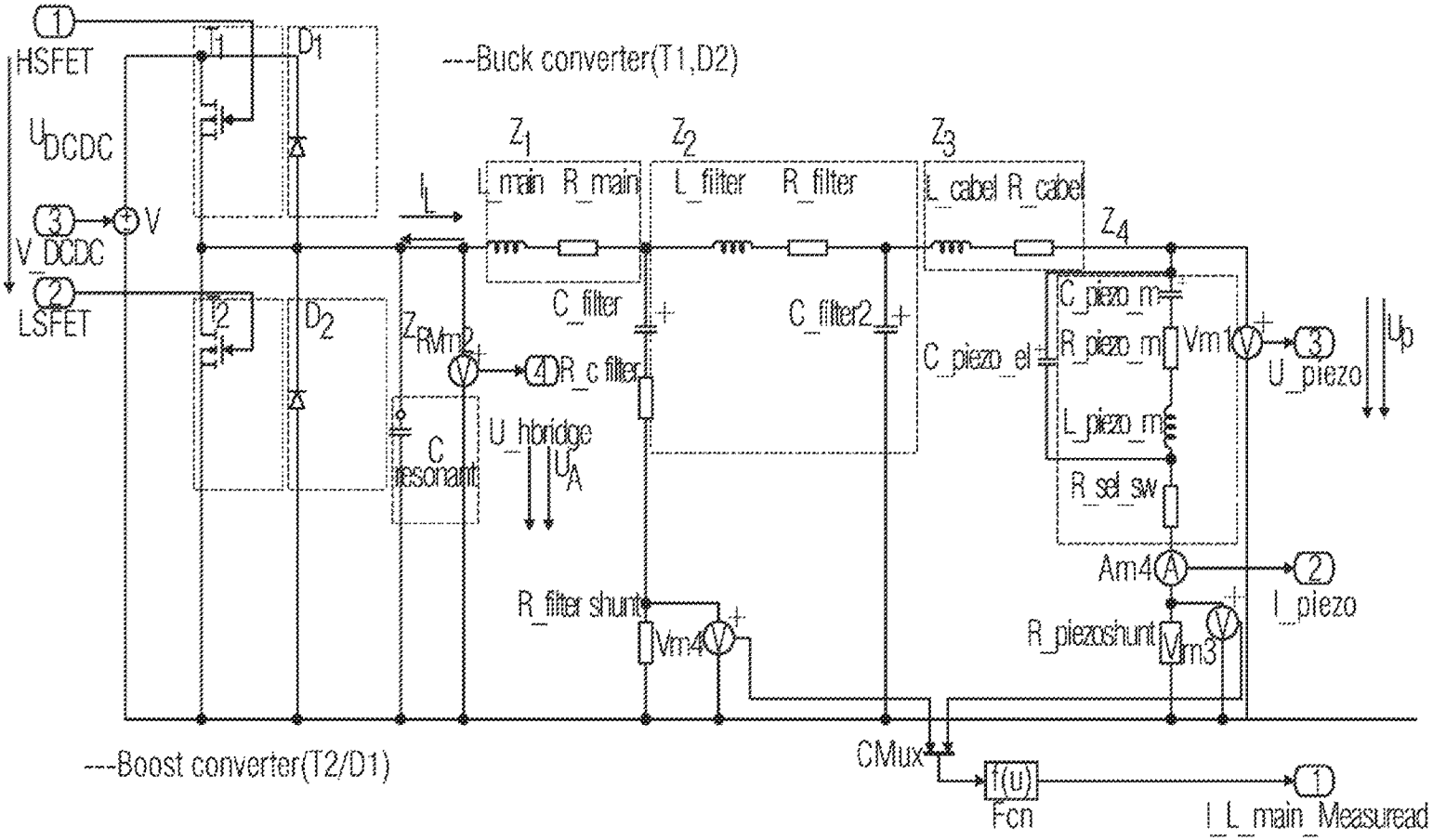
FIG. 1 shows a basic circuit of an example CC piezo output stage, according to teachings of the present disclosure.

Some embodiments may include a method in which the T on and/or T off switching times of the pulse-width-modulated piezo output stage of the piezo actuator are evaluated, and the state of the injection valve is derived from the result which is obtained. Easy identification of injection valve states may reduce and/or eliminate sensitivity to interference variables by evaluating the method of switching times of the pulse-width-modulated piezo output stage.

In some embodiments, the pulse-width modulation is carried out by evaluating comparator thresholds. A comparator compares a desired setpoint current of a main coil with the associated ACT current. If the ACT current exceeds a predefined setpoint current e.g. during the charging of the piezo actuator after the switching on of a switch T1 (T1 on), the comparator output switches the switch T1 off (T1 off) and the current decreases again. If the ACT current then reaches the zero crossing, the switch T1 is switched on again. This process repeats until a predefined charging time is reached. The pulse modulation of the discharging process (switch T2 on/T2 off) can be considered in an equivalent way.

In addition to the comparator operation, other specific operating modes can also be carried out for the pulse-width modulation (e.g., controlled pulse operation of the first pulse on the basis of minimum switching time behavior of the switches used). It is possible to derive from the method of the pulse modulation that the current gradient has a significant influence on the switching behavior. The rise function of the current is mainly influenced by the voltage difference between the terminal voltage $U_{DCDC}$ and the piezo voltage $U_P$. In some embodiments, this effect is used to detect injection valve states in the described method.

In some embodiments, the shifting of the voltage difference $U_{DCDC}-U_P$ (terminal voltage minus piezo voltage), brought about by a non-uniform change in the piezo voltage, is detected and evaluated as a change in the switching time behavior. Such a non-uniform change in the piezo voltage is caused by a change in external forces, for example the needle impact.

The methods for detecting injection valve states by evaluating T on/T off times of the piezo output stage (CC—current-controlled—output stage) can be carried out in various ways. For example, in some embodiments, the prespecified value and/or the real voltage at the injector are mapped by measuring the ON times (T on). In some embodiments, the ON (T on) time and OFF (T off) time are measured. This results in a behavior as in the first embodiment described above.

In some embodiments, the ON (T on) time and OFF (T off) time are measured in the actuation path. In particular, the times are measured upstream of the gate driver and/or directly at the gate of the power MOS. In this context, the mean value of the actuation pulse is preferably measured, for example with a low-pass filter at the gate driver signal.

Some embodiments may include suppression of interference and further filtering by means of a low-pass filter. Such embodiments may include comparison with a typical control characteristic curve (different in the various methods). In both cases, the internal resistance of the load is to be taken into account as an offset/shift of the characteristic curve.

In some embodiments, identifying an injection valve state is based on the use of a piezo output stage is based, for example, on a 2-quadrant buck converter (also known as a step-down converter) or boost converter (also known as a step-up converter). The topology of this CC (current-controlled) output stage can be described in a simplified way by means of an anti-parallel connection of a buck converter (TSS) and a boost converter (HSS). The operating modes are characterized in that in the buck converter mode the coil current $i_L$ of the main inductance is >0, and in the boost converter mode $i_L$ is <0. In the CC output stage there is no overlap between the two operating modes, with the result that just one coil is sufficient, as illustrated in FIG. 1. In the buck converter operating mode the piezo actuator is charged, e.g., the switch T1 is alternately switched on and off by pulse-width modulation. During the switch-on time of T1 (T1 on), the diode D2 initially has a blocking effect and the current in the coil rises. In this context energy is built up in the coil (magnetic accumulator). The current rises here uniformly according to the rule (1) and the coil voltage corresponds approximately to the value of $U_{DCDC}$ (terminal voltage) at the start of the charging process.

$$i_L = \frac{1}{L}\int u\,dt \tag{1}$$

The differential current of the main inductance in the switch-on phase of T1 can be described according to (2):

$$\frac{di}{dt} = \frac{U_{DCDC} - U_P}{L_{MAIN}} \tag{2}$$

During the switch-off phase (T1 off), the energy stored in the inductance is decreased. The diode D2 then acts in a free-wheeling manner, with the result that the load current can continue to flow. Since the output voltage is now present at the coil, the polarity of the coil voltage changes and therefore the output current decreases continuously. In this case, the piezo actuator is fed by the coil. Therefore, the rule according to (3) applies for the differential consideration of the current at the main inductance during the switch-off phase:

$$\frac{di}{dt} = \frac{-U_P}{L_{MAIN}} \tag{3}$$

The discharging of the piezo actuator is carried out using the boost converter ($i_L$<0), wherein the piezo actuator acts as a voltage source and therefore prespecifies the level of the terminal voltage. As in the case of the buck converter, the boost converter is also operated in a pulse-modulated fashion. During the switch-on phase of T2 (T2 on), firstly a freewheeling mode occurs, e.g., the current flows via the switch T2, and the current in the coil (4) therefore rises. In the switch-off phase for T2, feedback takes place via both diodes D1/D2 into the intermediate circuit of the direct voltage converter (source). In this case, the current flows from the consumer (piezo) back into the source via the coil.

$$\frac{di}{dt} = \frac{U_P}{L_{MAIN}} \tag{4}$$

The following rule (5) therefore applies for the current during the switch-off phase (T2 off):

$$\frac{di}{dt} = \frac{U_P - U_{DCDC}}{L_{MAIN}} \tag{5}$$

Owing to the method of functioning of the 2-quadrant converter, the conversion of power by the converter is reduced during the discharging phase with a decreasing level of the piezo voltage. This results in a significantly longer discharging time occurring and the piezo actuator is not completely discharged under certain circumstances. In order to avoid these phenomena, at the time of the discharge a current-regulated resistance is connected in parallel with the piezo actuator.

As already stated above, in some embodiments, the pulse-width modulation (T on/T off) is brought about, formulated in simplified terms, by evaluating comparator thresholds. Details on this have already been explained above.

Figure 2:
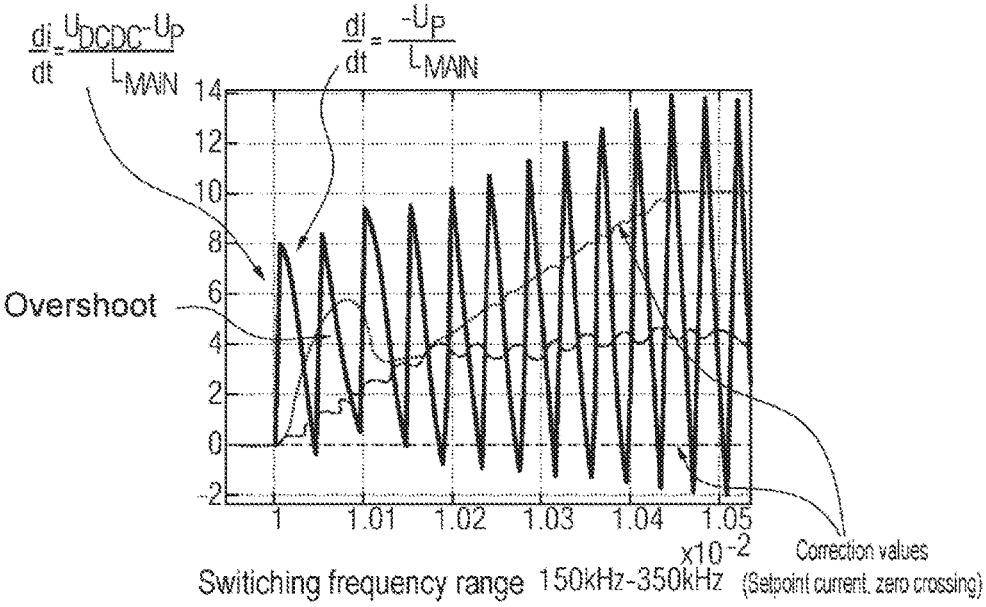
FIG. 2 shows example comparator behavior of the charging process, according to teachings of the present disclosure.

The comparator behavior of the charging process is illustrated in FIG. 2.

Figure 3:
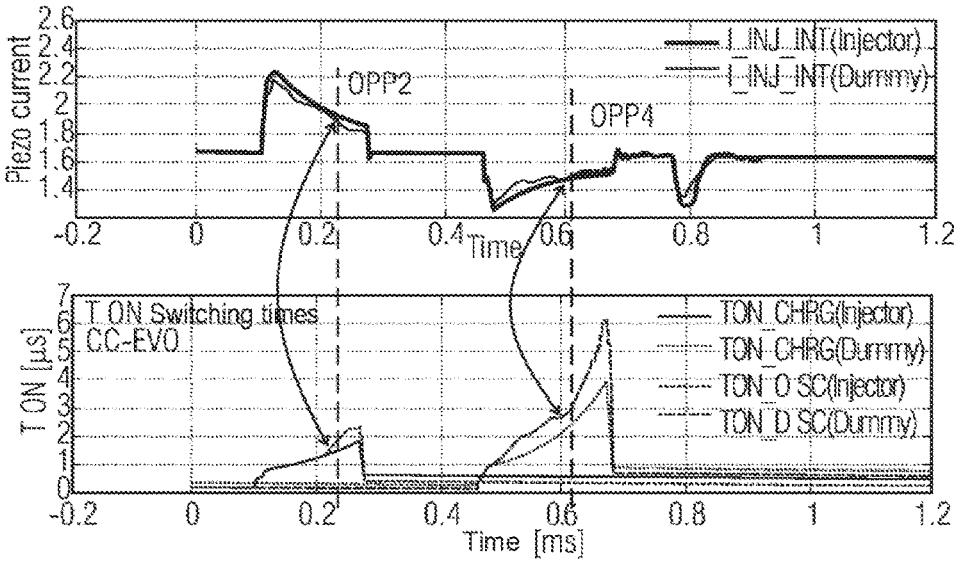
FIG. 3 shows the difference between the T on times in the case of a real injector load and in the case of an electronic equivalent load, according to teachings of the present disclosure.

FIG. 3 shows a juxtaposition of the T on times of a real measurement and those of an electronic equivalent load (injector with feedback as against electronic equivalent load).

What is claimed is:

1. A method for operating an internal combustion engine with one or more injection valves having nozzle needles activated by a respective piezo actuator, the method comprising:

actuating a particular piezo actuator in a pulse-width-modulated manner;

recording the T on and/or T off switching times of the pulse-width-modulated piezo output stage of the particular piezo actuator;

evaluating the recorded switching times to derive a position of the nozzle needle of the injection valve associated with the particular piezo actuator; and using the derived positions to control actuation of the particular piezo actuator during operation of the internal combustion engine.

2. The method as claimed in claim 1, further comprising modifying the pulse-width by evaluating comparator thresholds.

3. The method as claimed in claim 1, further comprising:

detecting a shift of voltage difference $U_{DCDC}$−UP (terminal voltage minus piezo voltage) resulting from a non-uniform change in piezo voltage; and evaluating the shift of voltage difference as a change in the switching times.

4. The method as claimed in claim 1, wherein a prespecified value and/or a real voltage at the injector is mapped by measuring a T on time.

5. The method as claimed in claim 1, further comprising measuring an ON (T on) time and an OFF (T off) time.

6. The method as claimed in claim 1, further comprising measuring an ON (T on) time and an OFF (T off) time in the actuation path.

7. The method as claimed in claim 6, wherein the ON and OFF times are measured upstream of the gate driver and/or directly at the gate of the power MOS.

8. The method as claimed in claim 6, further comprising measuring the mean value of the actuation pulse.

* * * * *